US006314948B1

(12) United States Patent
Cathcart

(10) Patent No.: US 6,314,948 B1
(45) Date of Patent: Nov. 13, 2001

(54) FUEL INJECTION SYSTEM CONTROL METHOD

(75) Inventor: Geoffrey Paul Cathcart, Yokine (AU)

(73) Assignee: Obital Engine Company (Australia) Pty Limited, Balcatta (AU)

( * ) Notice: Subject to any disclaimer, the term of this patent is extended or adjusted under 35 U.S.C. 154(b) by 0 days.

(21) Appl. No.: 09/744,984

(22) PCT Filed: Aug. 20, 1999

(86) PCT No.: PCT/AU99/00674

§ 371 Date: Feb. 16, 2001

§ 102(e) Date: Feb. 16, 2001

(87) PCT Pub. No.: WO00/11337

PCT Pub. Date: Mar. 2, 2000

(30) Foreign Application Priority Data

Aug. 21, 1998 (AU) ..... PP 5410
Sep. 14, 1998 (AU) ..... PP 5716

(51) Int. Cl.[7] ..... F02M 23/04
(52) U.S. Cl. ..... 123/533; 123/479
(58) Field of Search ..... 123/531–534, 123/479

(56) References Cited

U.S. PATENT DOCUMENTS 5,150,692 9/1992 Trombley et al. ..... 123/533
5,884,611 * 3/1999 Tarr et al. ..... 123/531
6,164,268 * 12/2000 Worth et al. ..... 123/533

FOREIGN PATENT DOCUMENTS 0 420 288 4/1991 (EP) .
2 317 028 3/1998 (GB) .

* cited by examiner

*Primary Examiner*—Erick Solis
(74) *Attorney, Agent, or Firm*—Arent Fox Kintner Plotkin & Kahn PLLC

(57) ABSTRACT

A method of controlling a dual fluid fuel injection system of an internal combustion engine having at least one cylinder, the fuel injection system having at least one delivery injector and a compressed gas supply means for supplying gas to the at least one delivery injector, the method including:

determining if there has been a reduction in the compressed gas supplied to the at least one delivery injector below a required supply level;

opening the at least one delivery injector when there is a depression in a respective said cylinder such that the pressure within said cylinder is lower than the pressure upstream of the delivery injector if the compressed gas supply is below said required supply level; and delivering fuel to the delivery injector such that the fuel is drawn into the cylinder by virtue of the pressure differential existing across the delivery injector.

15 Claims, 3 Drawing Sheets

FUEL INJECTION SYSTEM CONTROL METHOD

The present invention is generally directed to dual fluid fuel injection systems for internal combustion engines, and in particular to a method of controlling such dual fluid fuel injection systems.

The Applicant has developed dual fluid fuel injection systems for use in internal combustion engines wherein metered quantities of fuel are injected into the combustion chamber(s) of an engine, entrained in a compressed gas. An example of such a system is described in the Applicant's U.S. Pat. No. 4,934,329, the details of which are incorporated herein by reference. Such systems require a source of compressed gas such as an air compressor to operate properly. The compressed gas is supplied to the delivery or air injectors of the fuel injection system which deliver fuel into the engine. Typically, separate fuel supply means supply metered quantities of fuel to each delivery injector and the compressed gas entrains and delivers the fuel to the engine when the delivery injector is opened. Such air-assisted fuel injection has been shown to promote improved fuel spray formation and distribution within the combustion chambers of the engine, leading to benefits such as improved emissions, fuel economy and engine operating stability.

However, the gas supply upon which the dual fluid fuel injection system is reliant can be lost if for example there is a mechanical failure of the air compressor or a break or significant leak in the air supply system between the air compressor and the delivery injectors of the dual fluid fuel injection system. Such a loss of the compressed gas supply to the delivery injectors will prevent the dual fluid fuel injection system from operating properly resulting in unsatisfactory engine operation or in fact thereby disabling the engine. That is, no, or an unsatisfactory quantity of compressed gas will be available at each delivery injector to entrain and deliver fuel into the combustion chambers of the engine.

It is therefore an object of the present invention to provide a method of operating a dual fluid fuel injection system if there is such a disruption of the compressed gas supply to the delivery injector.

With this in mind, there is provided a method of controlling a dual fluid fuel injection system of an internal combustion engine having at least one cylinder, the fuel injection system having at least one delivery injector and a compressed gas supply means for supplying gas to the at least one delivery injector, the method including:

- determining if there has been a reduction in the compressed gas supplied to the at least one delivery injector below a required supply level;
- opening the at least one delivery injector when there is a depression in a respective said cylinder such that the pressure within said cylinder is lower than the pressure upstream of the delivery injector if the compressed gas supply is below said required supply level; and
- delivering fuel to the delivery injector such that the fuel is drawn into the cylinder by virtue of the pressure differential existing across the delivery injector.

The term "cylinder depression" refers to the condition where the pressure within the cylinder is lower than a reference pressure, in this case, the pressure upstream of the delivery injector.

The delivery injector(s) may inject fuel directly into a respective said cylinder. In the case of a multi-cylinder engine, each cylinder may be provided with a respective said delivery injector.

Conveniently, the compressed gas supply means comprises an air compressor and air supply means for communicating the output of the air compressor with the delivery injector(s) of the fuel injection system. The reduction in the compressed gas supplied to the at least one delivery injector may typically be constituted by an interruption of the compressed gas supply from the air compressor. Alternatively, the reduction may arise due to a failure, break or leak within the air supply means communicating the compressor with the delivery injector(s).

The method according to the present invention may control the duration of opening of the delivery injector. Alternatively or in addition, the start of opening of the delivery injector may be controlled.

Preferably, the start of opening and duration of opening of a said delivery injector of a said cylinder of the engine occurs when the cylinder is undergoing an intake stroke therein. Preferably, fuel is delivered to the delivery injector at least in the period when the delivery injector is opened.

Conveniently, the delivery injector is actuated by way of an electromagnetic solenoid such that, even though the source of compressed gas may have been interrupted or reduced, the delivery injector may still be operated to provide communication with a cylinder of the engine. Such electromagnetic control is well known in the field of fuel injection systems. It should however be noted that other suitable forms of delivery injector may also be used in accordance with the present invention.

The present invention relies on there being a lower pressure within the cylinder when the delivery injector is opened. As is well understood, when a piston within the cylinder is moving towards bottom dead centre on the intake stroke thereof, a vacuum is created within the cylinder. The vacuum induced in the cylinder during the intake stroke helps to draw the fuel held within or being supplied to the delivery injector into the cylinder whilst the delivery injector is held opened. This is because a pressure differential is created across the open delivery injector which enables a net mass flow of fluid from the delivery injector into the cylinder. This ensures that sufficient fuel is drawn into the cylinder to sustain the subsequent combustion event in the cylinder.

Depending on the timing of the opening of the delivery injector and hence the level of the pressure differential across the open delivery injector, sufficient air may be drawn from upstream of the delivery injector to still provide a desirable level of atomisation and entrainment of the fuel. That is, air may be drawn through the failed air compressor or the air supply means, and through the delivery injector to assist with the delivery of the metered quantity of fuel into the cylinder in the normal manner. This may of course depend on the type of failure or leak upstream of the delivery injector, however, measures may be adapted to ensure that air is able to be drawn through the delivery injector under such situations. For example, air may be drawn from another cylinder of the engine whose delivery injector is also controlled to be open.

Conveniently, the fuel may be delivered to the delivery injector during the period when the injector is opened. This may, for example, be the preferred timing at relatively low loads of the engine. However, as the load increases, and the fuel delivery requirements increase, the fuel delivery to the delivery injector may commence before the injector opens and continue while the injector is opened. In certain circumstances, all of the fuel may of course be metered into the delivery injector prior to the opening thereof. These alternatives ensure that a sufficient amount of fuel is delivered to the engine cylinder for different operating conditions. A fuel injector or other fuel metering means such as a positive displacement pump means may be used to supply fuel to the delivery injector.

The fuel metering means may deliver the fuel at a pressure sufficient to deliver the fuel through the delivering injector when open directly to the cylinder.

The operation of the delivery injector(s) and/or fuel injector or fuel metering means may be controlled by an Electronic Control Unit (ECU). Engine control systems utilising such ECUs are described in standard texts such as "The Motor Vehicle, twelfth edition (1996)" by K. Newton, W. Steeds and T. K. Garret and published by the Society of Automotive Engineers. Therefore, as the use of ECUs in engine control systems is well known to persons skilled in this art, the ECU will not be described herein in any detail.

The compressed gas supply means may include an air rail to which compressed gas may be delivered from the air compressor, and from which compressed gas is supplied to the delivery injector(s). Conveniently, the loss or reduction of the compressed gas supplied to the delivery injectors may be determined by sensing the pressure within the air rail. For example, a pressure sensor may be suitably located to measure the pressure within the air rail. The ECU may initiate the control method when the air rail pressure falls substantially below a required supply pressure indicating a loss or significant reduction in the gas supply to the air rail or a significant leak or break somewhere in the air supply means. Other means for determining the loss or a reduction in the compressed gas supply are however also envisaged. For example, an air flow sensor could be provided in an air line between the air compressor and the air rail. Further, a suitable sensor may be provided within the air compressor to indicate whether it is operating satisfactorily or not.

The method according to the present invention is particularly applicable to direct injected engines but may also have applications to certain manifold injection engines.

Further the method may be used on engines having single or multiple cylinders. Where the method is used on a multi-cylinder engine, the method may be used on one or more of the cylinders if not all of the cylinders.

The method according to the present invention can therefore provide a "limp home" mode of operation for the engine if there is a loss or significant reduction of the compressed gas supply to the dual fluid fuel injection system.

The method according to the present invention is particularly applicable for four stroke engines where there is little possibility of the fuel being lost through the exhaust port(s) during the intake stroke. It is however also envisaged that the present invention may be adapted for use on two stroke engines.

It will be convenient to describe the present invention with reference to the accompanying drawings which show a preferred embodiment of a control method according to the present invention. Other arrangements of the invention are however possible, and consequently, the particularity of the accompanying drawings is not to be understood as superseding the generality of the preceding description of the invention.

Figure 1:
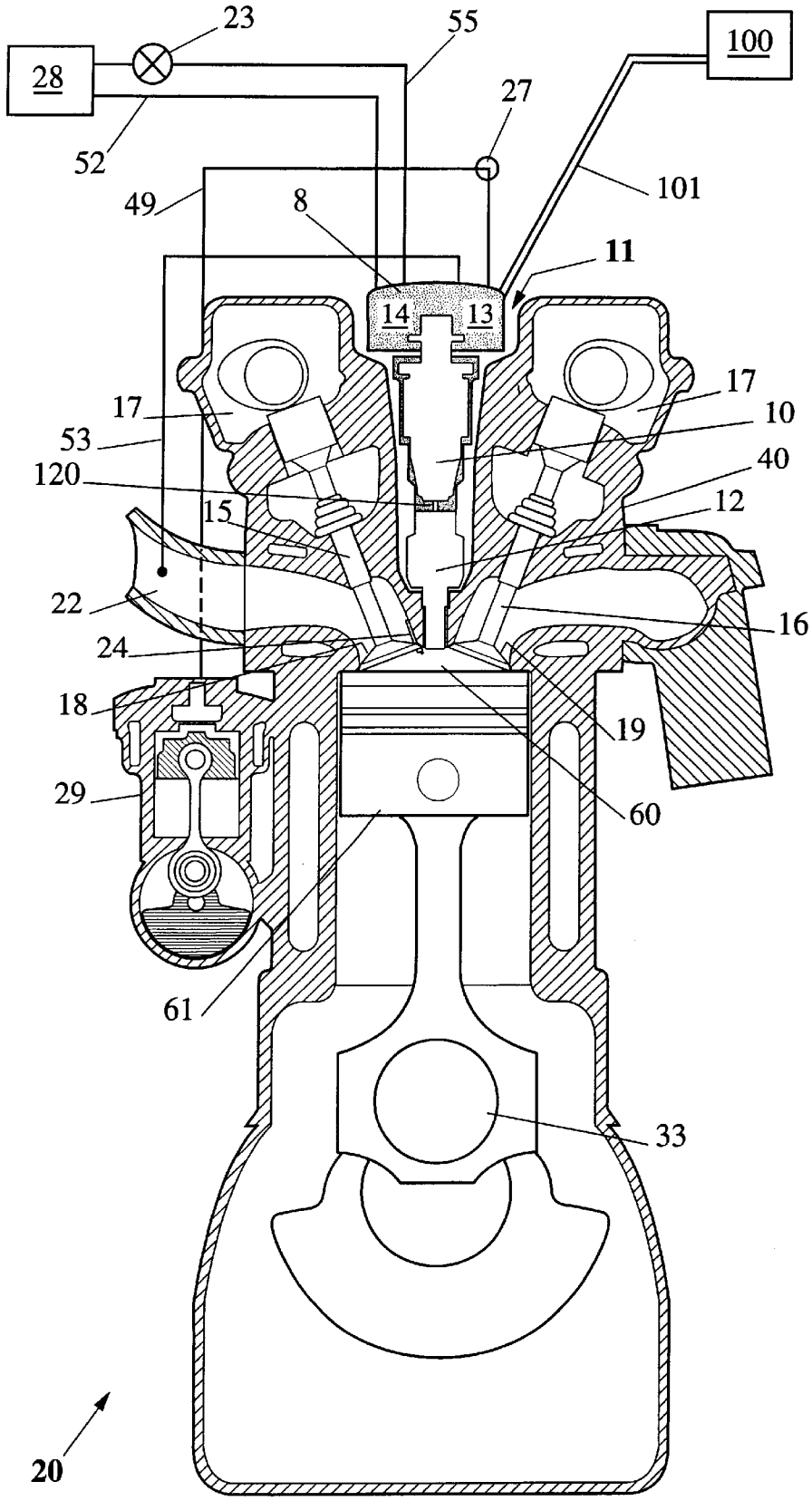
FIG. 1 is a cross-sectional view of an internal combustion engine having a fuel and air rail unit mounted thereon.

FIG. 1 shows a direct injected four stroke internal combustion engine 20 comprising a fuel injection system, the engine 20 having an air intake system 22, an ignition means 24, a fuel pump 23, and a fuel reservoir 28. An air compressor 29 is operatively arranged with respect to the engine 20 and typically driven off the engine crankshaft 33 by way of a suitable belt (not shown). Mounted in the cylinder head 40 of the engine 20 is a fuel and air rail unit 11. The fuel pump 23 draws fuel from the fuel reservoir 28 which is then supplied to the fuel and air rail unit 11 through a fuel supply line 55. Conventional inlet and exhaust valves 15 and 16 are also mounted in the cylinder head 40 in the known manner together with conventional cam means 17 for actuating the valves 15, 16. The valves 15, 16 are arranged to open and close corresponding inlet and exhaust ports 18 and 19 for admission of fresh air and the removal of exhaust gases from the cylinder in the known manner.

Figure 2:
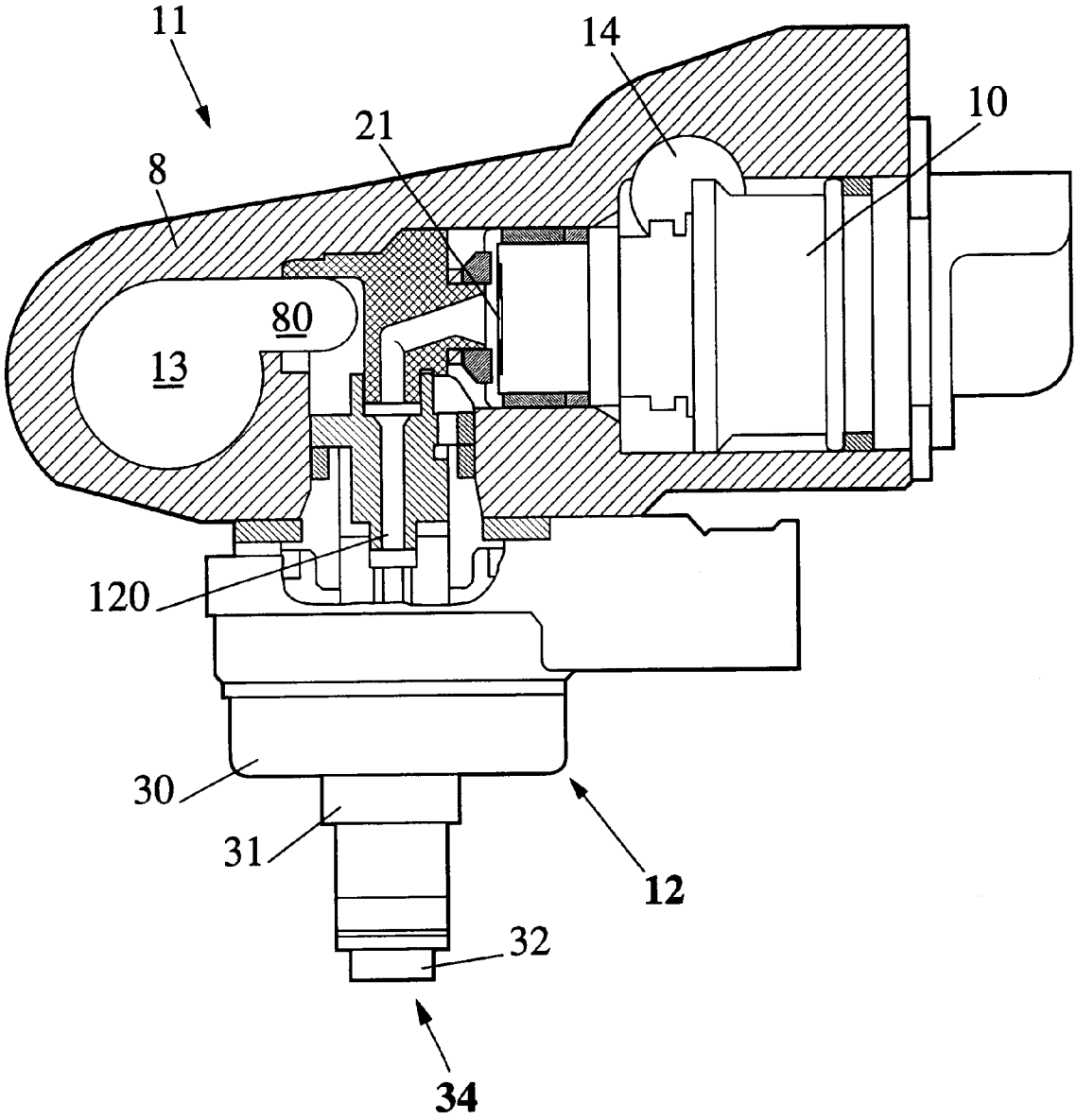
FIG. 2 is a partial cross-sectional view of a fuel and air rail unit.

Referring now to FIG. 2, there is shown in detail a fuel and air rail unit 11 which, whilst being different in design from that shown in FIG. 1, shares all the same components thereof. The fuel and air rail unit 11 comprises a fuel metering unit 10 and an air or delivery injector 12 for the or each cylinder of the engine 20. The fuel metering unit 10 is commercially available and requires no detailed description herein. Suitable ports are provided to allow fuel to flow through the fuel metering unit 10 and a metering nozzle 21 is provided to deliver fuel to a passage 120 and thence to the air injector 12. The body 8 of the fuel and air rail unit 11 may be an extruded component with a longitudinally extending air duct 13 and a fuel supply duct 14.

As best seen in FIG. 1, at appropriate locations, there are provided connectors and suitable ducts communicating the rail unit 11 with air and fuel supplies: air line 49 communicating air duct 13 with the air compressor 29; air line 53 providing an air outlet which returns air to the air intake system 22; and fuel line 52 communicating the fuel supply duct 14 and fuel reservoir 28 providing a fuel return passage. The air duct 13 communicates with a suitable air regulator 27 which regulates the air pressure of the compressed air provided by the air compressor 29 to the air duct 13.

Referring again to FIG. 2, the air injector 12 has a housing 30 with a cylindrical spigot 31 projecting from a lower end thereof, the spigot 31 defining an injection port 32 communicating with the passage 120. The injection port 32 includes a solenoid operated selectively openable poppet valve 34 operating in a manner similar to that as described in the Applicant's U.S. Pat. No. 4,934,329, the contents of which are hereby incorporated by reference. As seen in FIG. 1, energisation of the solenoid in accordance with commands from an electronic control unit (ECU) 100 opens the valve 34 to deliver a fuelgas mixture to a combustion chamber 60 of the engine 20. However, it is not intended to limit the valve construction to that as described above and other valves, for example, pintle valve constructions, could be employed. The electronic control unit (ECU) 100 typically receives signals indicative of crankshaft speed and air flow from suitably located sensors within the engine (not shown). The ECU 100, which may also receive signals indicative of other engine operating conditions such as the engine temperature and ambient temperature (not shown), determines from all input signals received the quantity of fuel required to be delivered to each of the cylinders of the engine 20. As alluded to hereinbefore, this general type of ECU is well known in the art of electronically controlled fuel injection systems and will not be described here in further detail.

The opening of each injector valve 34 is controlled by the ECU 100 via a respective communicating means 101 in timed relation to the engine cycle to effect delivery of fuel from the injection port 32 to a combustion chamber 60 of the engine 20. By virtue of the two fluid nature of the system, fuel is delivered to the cylinder entrained in a gas. The passage 120 is in constant communication with the air duct 13 via the conduit 80 as shown in FIG. 2 and thus, under normal operation, is maintained at a substantially steady air pressure. Upon energisation of the solenoid of the air injector 12, the valve 34 is displaced downwardly to open the injection port 32 so that a metered quantity of fuel delivered into the air injector 12 by the fuel metering unit 10 is carried by air through the injection port 32 into the combustion chamber 60 of a cylinder of the engine 20.

Typically, the air injector 12 is located within the cylinder head 40 of the engine 20, and is directly in communication with the combustion chamber 60 defined by the reciprocation of a piston 61 within the engine cylinder. As above described, when the injection port 32 is opened and the air supply available via the conduit 80 is above the pressure in the engine cylinder, air will flow from the air duct 13 through the passage 80, passage 120 and, entrained with fuel, injection port 32, into the engine combustion chamber 60. Under normal operating conditions, this typically occurs as the piston is moving towards its top dead centre position during the compression stroke within the cylinder.

If however the compressed air supply from the air compressor 29 is interrupted or significantly reduced due, for example, to a mechanical fault in the air compressor 29 or to a break or leak in the air line 49 or air rail 13, then the fuel and air rail unit 11 is no longer able to operate in the manner described above. The control method according to the present invention enables the engine to continue to operate under such circumstances to thereby provide a "limp home" mode of operation.

Figure 3:
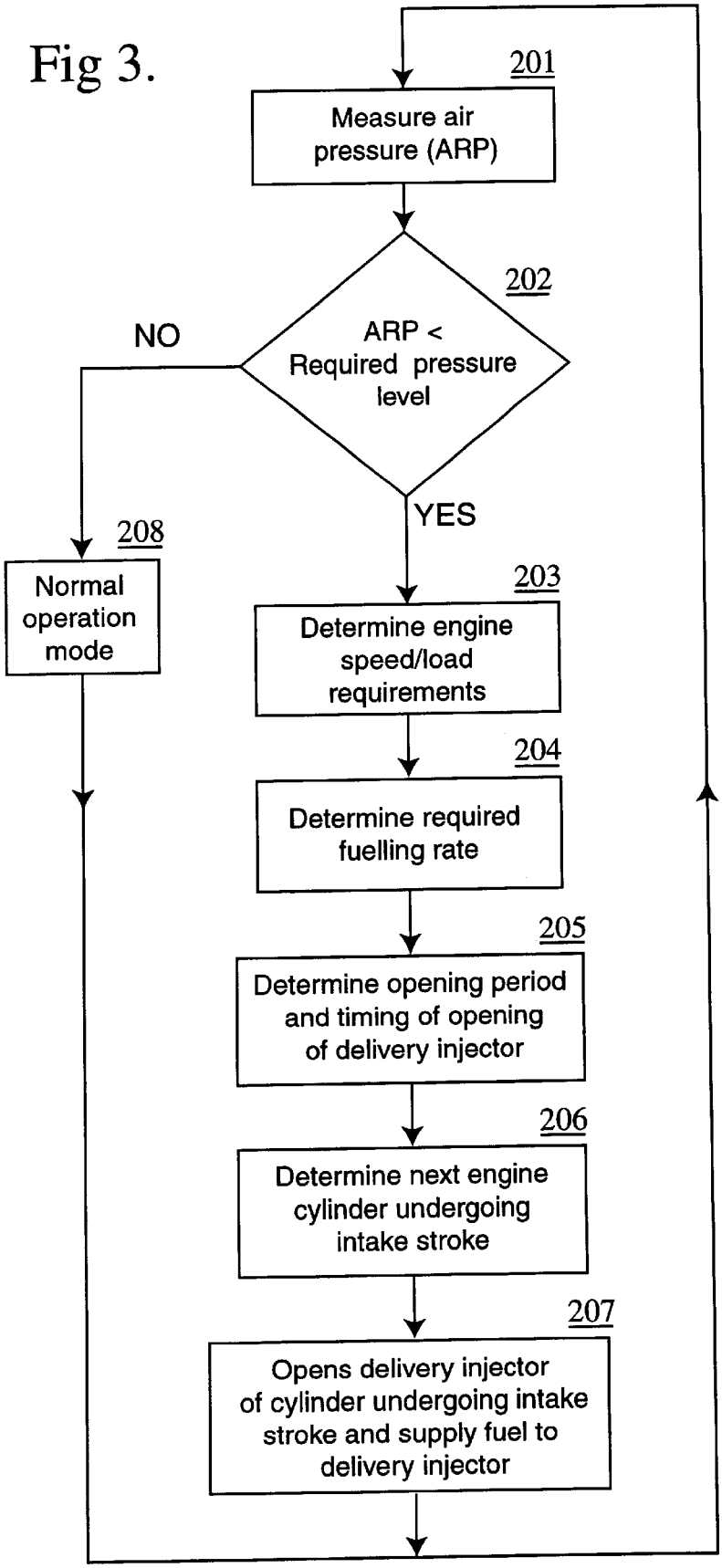
FIG. 3 is a flow diagram showing a preferred embodiment of a method of operating a dual fluid fuel injection system according to the present invention.

Referring to the flow diagram in FIG. 3, the air rail pressure (ARP) is continually monitored or periodically measured (step 201) to determine when there is any loss of or significant reduction in the air pressure to the fuel and air rail unit 11. If the air rail pressure is greater than or equal to a required air pressure level in the rail unit 11 (step 202), then the fuel injection system operates in the normal manner (step 208). If however the air rail pressure drops significantly below the required pressure level, the ECU reacts to control the fuel injection system according to the present invention, whereby the engine operating conditions are determined (step 203) and the required fuelling rate is determined (step 204). A period and the timing of opening of the delivery injector 12 to effect the required fuel delivery is then determined (step 205). This would typically be based on the prevailing engine speed/load which would determine when the injector 12 was required to be opened in order to effect satisfactory fuel delivery to the engine. As alluded to hereinbefore, this will typically correspond to a point when the pressure in the respective cylinder is less than the reduced pressure upstream of the delivery injector 12 and obviously prior to a point at which a subsequent combustion event will occur. Hence, this will most commonly equate to the intake stroke within the cylinder wherein the piston 61 is moving towards its bottom dead centre position in the cylinder.

Hence, following the determination of the next engine cylinder to undergo an intake stroke therein (step 206), the delivery injector 12 of that cylinder is opened for the previously determined period at the selected timing, with the required amount of fuel previously determined being supplied to the delivery injector 12 (step 207) during this open period thereof. As alluded to hereinbefore, the metered quantity of fuel may of course be provided to the injector 12 prior to the opening thereof, partly before and partly during the open period thereof, or completely during the open period thereof.

The fuel metering unit 10 can in fact deliver the fuel at a pressure sufficient to deliver fuel through the delivery injector 12 directly to the combustion chamber 60.

For example, the fuel metering unit 10 can supply the fuel during the period of opening of the delivery injector 12, particularly at low loads. At higher loads, where a greater amount of fuel is required, the fuel metering unit 10 may commence or complete fuel delivery to the delivery injector 12 prior to the opening thereof. The fuel metering unit 10 is of course still able to accurately meter fuel as the fuel pressure is governed by the fuel pump 23 and any fuel regulation means associated with the fuel rail 14. The interruption or reduction of the supply of compressed air will generally not affect the operation of the delivery injector 12.

By virtue of the fact that the delivery injector 12 is opened at a time when the pressure in the cylinder is lower than the reduced or unsatisfactory air pressure upstream of the delivery injector 12 (i.e. in the air rail 13), fuel is drawn into the cylinder by way of the pressure differential existing across the delivery injector 12. Further, by controlling the timing of the opening of the injector 12, sufficient air may be drawn through the open injector 12 to provide for a satisfactory level of atomisation and entrainment of the metered quantity of fuel.

Further, measures may be taken to ensure that the differential pressure across the delivery injector 12 is always at a suitable level. For example, where the engine 20 is controlled by way of a drive by wire (DBW) system, the main throttle value of the engine 20 may be controlled so as to not permit a wide open throttle (WOT) setting whilst the method according to the present invention is being used. In this way, an increased level of vacuum may be generated during the intake stroke of the four stroke engine and have a greater differential pressure will be created across the open delivery injector 12.

In regard to the required pressure level as discussed in reference to step 202, for certain engine applications this does not necessarily need to equate to the predetermined or desired air pressure at which the fuel injection system normally operates. That is, whilst the fuel injection system will typically be arranged to operate with a particular air pressure level as controlled by the regulator 27, the fuel injection system may in fact be able to satisfactorily operate when the air pressure is within a certain range below this predetermined air pressure level. Accordingly, the required pressure level as referred to in reference to step 202 at which the method according to the present invention will come into effect may not necessarily be the same as the normal predetermined operating air pressure for the fuel injection system. Instead, it may be set at some predetermined margin below this normal or desired system operating air pressure. In this way, a limp home mode of operation will not be instituted in cases where the pressure is just slightly below the normal operating air pressure for the system. For example, whilst the normal system air pressure may be say 600 Kpa, the required pressure level below which the engine is controlled by the method as described may be set at say 400 Kpa.

The method according to the present invention is particularly applicable for four stroke engines. It is however also envisaged that this method could be used on two stroke engines. The invention is equally applicable to single cylinder configurations and multi-cylinder engines of any number of cylinders. Further, the method according to the present invention is particularly applicable to direct injected engines, but may also be adapted to operate on manifold injected engines.

For example, if the injector 12 was arranged immediately upstream of the inlet port 18, the vacuum within the cylinder during the intake stroke could be used to draw fuel and air from the delivery injector 12, through the open inlet port 18 (as the valve 15 would be opening port 18 during the intake stroke so as to allow fresh air for subsequent combustion to be drawn into the cylinder) and hence into the combustion chamber 60 for subsequent ignition. Hence the opening of the injector 12 in such an alternative system would require to be timed with respect to the openirig of the inlet port 18 by the inlet valve 15.

Modifications and variations as would be deemed obvious to the person skilled in the art are included within the ambit of the present invention.

The claims defining the invention are as follows:

1. A method of controlling a dual fluid fuel injection system of an internal combustion engine having at least one cylinder, the fuel injection system having at least one delivery injector and a compressed gas supply means for supplying gas to the at least one delivery injector, the method including:

determining if there has been a reduction in the compressed gas supplied to the at least one delivery injector below a required supply level;

opening the at least one delivery injector when there is a depression in a respective said cylinder such that the pressure within said cylinder is lower than the pressure upstream of the delivery injector if the compressed gas supply is below said required supply level; and delivering fuel to the delivery injector such that the fuel is drawn into the cylinder by virtue of the pressure differential existing across the delivery injector.

2. A method according to claim 1, wherein the delivery injector injects fuel directly into a respective said cylinder.

3. A method according to claim 1, including controlling the duration of opening of the delivery injector.

4. A method according to claim 1, including controlling the start of opening of the delivery injector.

5. A method according to claim 1, including opening the delivery injector when the cylinder is undergoing an intake stroke therein.

6. A method according to claim 1, including opening the delivery injector when there is a vacuum induced in the cylinder.

7. A method according to claim 1, including delivering fuel to the delivery injector at least in the period when the delivery injector is opened.

8. A method according to claim 1, including commencing the fuel delivery to the delivery injector before the injector opens and continuing the fuel delivery while the injector is opened.

9. A method according to claim 1, including delivering all of the fuel to the delivery injector prior to the opening thereof.

10. A method according to claim 1, including delivering all of the fuel to the delivery injector after the opening thereof.

11. A method according to claim 8 wherein the fuel is supplied to the delivery injector by a fuel metering unit at a pressure sufficient to deliver the fuel through the delivery injector when open directly to the cylinder.

12. A method according to claim 1, wherein the compressed gas supply means includes an air rail to which compressed gas is delivered from an air compressor and from which compressed gas is supplied to the delivery injector, the method including sensing the pressure within the air rail and initiating the control method when the air rail pressure falls substantially below the required supply level.

13. A method according to claim 1, wherein the compressed gas supply means includes an air rail to which compressed gas is delivered from an air compressor and from which compressed gas is supplied to the delivery injector, the method including sensing the air flow within a gas line between the compressor and the air rail and initiating the control method when the air flow falls substantially below a predetermined level.

14. A method according to claim 1, wherein the compressed gas supply means includes an air rail to which compressed gas is delivered from an air compressor and from which compressed gas is supplied to the delivery injector, the method including sensing the operation of the air compressor and initiating the control method when the air compressor is not operating satisfactorily.

15. A method according to claim 1, wherein the engine is a four stroke engine.

* * * * *